United States Patent [19]

Margittai

[11] 4,215,743

[45] Aug. 5, 1980

[54] COAXIAL HEAT EXCHANGER DEVICE

[76] Inventor: Thomas B. Margittai, 778 Cornwall Rd., State College, Pa. 16801

[21] Appl. No.: 884,554

[22] Filed: Mar. 8, 1978

[51] Int. Cl.[3] ..... F28D 7/00; F28F 9/22

[52] U.S. Cl. ..... 165/141; 165/155

[58] Field of Search ..... 165/141, 142, 154, 155, 165/156, 160, 161, 169

[56] References Cited

U.S. PATENT DOCUMENTS

| | | | |
|---|---|---|---|
| 2,870,997 | 1/1959 | Söderstrom | 165/141 |
| 3,612,002 | 10/1971 | Margittai | 165/155 |
| 3,848,665 | 11/1974 | Uerlichs et al. | 165/170 |

*Primary Examiner*—Sheldon Richter

*Attorney, Agent, or Firm*—Thomas E. Sterling

[57] ABSTRACT

This invention is a heat exchanger device which is an improvement on U.S. Pat. No. 3,612,002, Liquid-Heating Apparatus by the same inventor. The invention is a heating or cooling apparatus for liquids which lends itself to quick disassembly and reassembly and which contains a hollow double flange inlet for the introduction of heating medium, a double helix to lead the heating medium inside of hollow concentric cylinders, and a hollow flange with two chambers for the introduction of fluid. In addition, the apparatus is modified by rounding its internal structure to allow coating of its internal surface with a corrosion resistant film such as glass, plastic or the like. A further modification of the invention comprises the construction of cylindrical elements with spiral paths therethrough.

9 Claims, 11 Drawing Figures

Fig. 1.
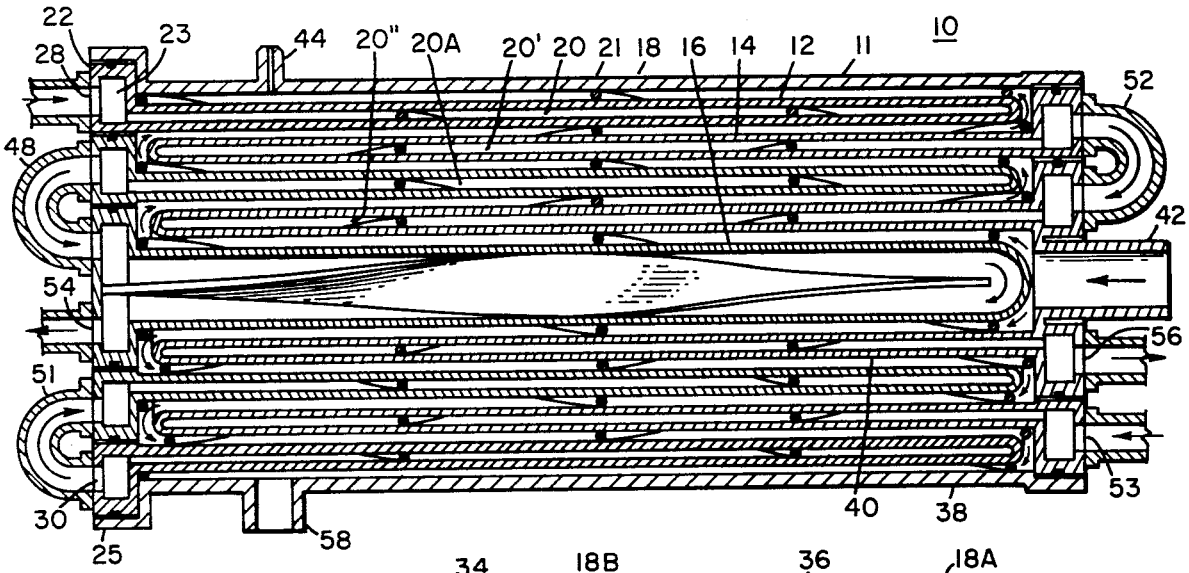
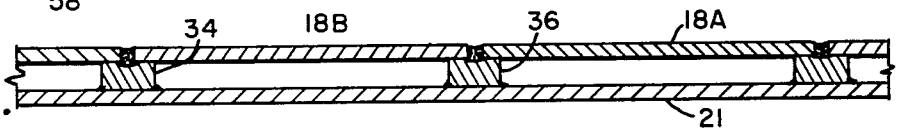
Fig. 3a.
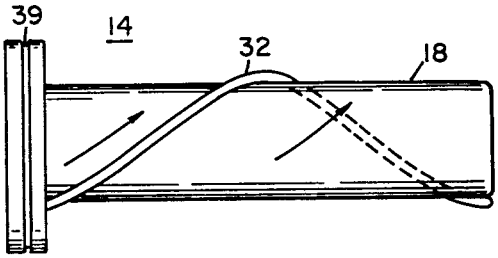
Fig. 2.
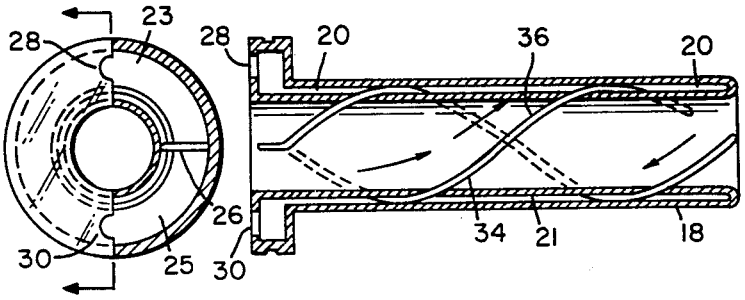
Fig. 3.
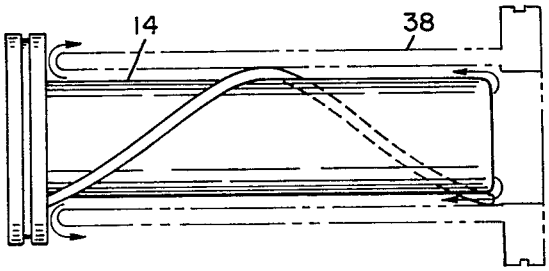
Fig. 4.

Fig. 5.
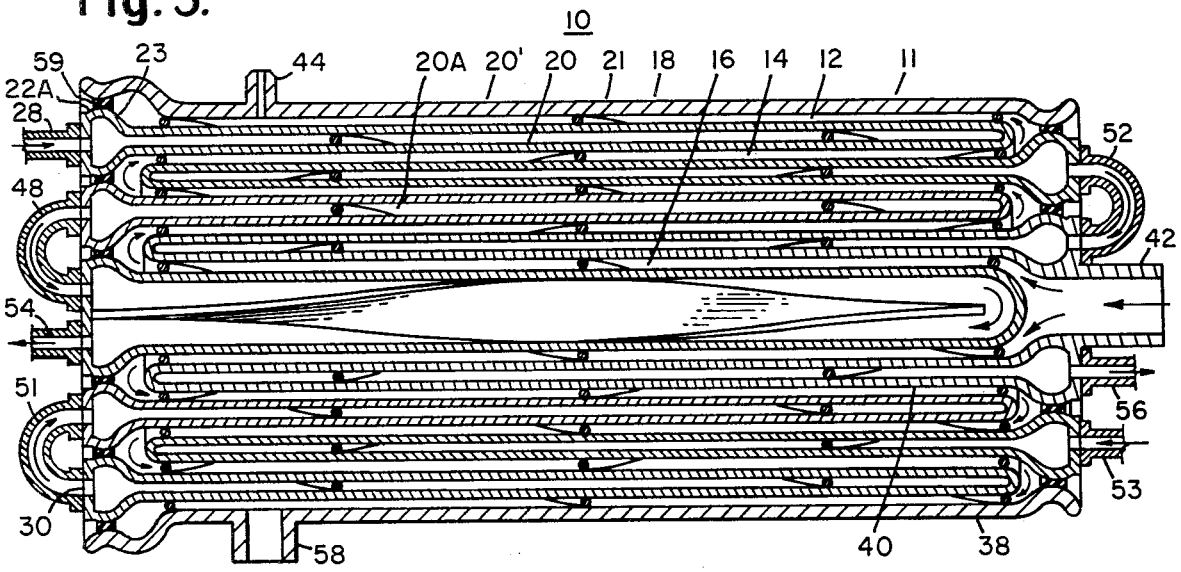
Fig. 6a.
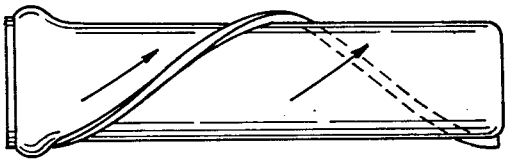
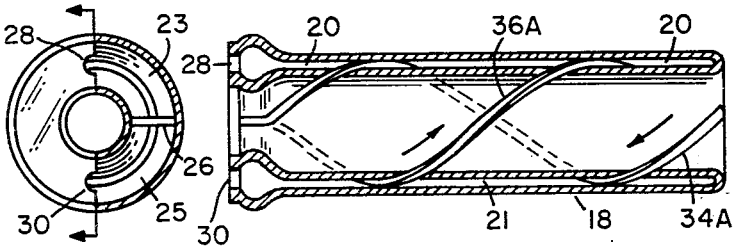
Fig. 6.
Fig. 7.
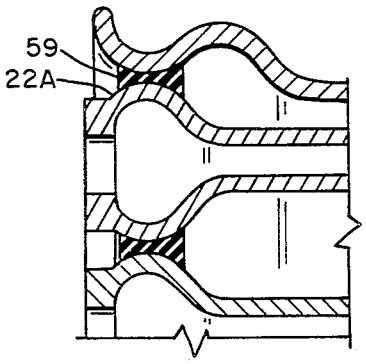

COAXIAL HEAT EXCHANGER DEVICE

PRIOR ART STATEMENT

The below-listed prior art of United States Patents includes what the inventor considers to be the closest art of which he is aware. The inventor is not withholding known prior art which he considers closer than that which is hereinafter listed:

U.S. Pat. No. 1,826,750 10/1931 Demers;
U.S. Pat. No. 2,145,084 1/1939 Hersey;
U.S. Pat. No. 2,870,997 1/1959 Söderstrom;
U.S. Pat. No. 3,612,002 10/1971 Margittai.

The basic design of this invention is similar to that described in U.S. Pat. No. 3,612,002, LIQUID-HEATING APPARATUS by Thomas Margittai, patented Oct. 12, 1971. The present invention represents an improvement over the above patent and its specification and claims should be read in conjunction with this patent for a fuller understanding thereof. This present invention differs from the prior patent in the below-indicated improvements:

1. A hollow double flange inlet for the introduction of heating medium into the device;
2. A double helix to lead the heating medium flowing down and up inside the hollow concentric cylinders;
3. O-ring gaskets on the outer edge of the assembly flange;
4. Hollow flanges with two chambers in the end portion of the cylindrical elements;
5. Modification of the basic design permitting glass coating of elements, and
6. Processes for the manufacture of helical elements on the surface of the cylindrical elements. U.S. Pat. No. 3,612,002 is thus incorporated by reference to this application which should be read with this patent in view.

This cartridge heat exchanger invention generally is made up of any number of double-wall cartridges placed one inside the other, like a double-ended collapsible telescope. The heating or cooling medium circulates inside the cartridges, in a double helix path, from the largest to the smallest cartridge or vice versa. The product flows in a helix or spiral between the cartridges from the center out or vice versa. Baffles or dividers inside of the cartridges and on the outside direct the cooling medium and the product in a spiral or helical manner.

The cooling or heating medium circulates inside of the cartridges while the product flows in a spiral between the cartridges from the center out or vice versa. The pitch of the coils or baffles on the surface of each cartridge determines the velocity of both the medium and product. A change in coil or baffle pitch changes the velocity, thus allowing any size unit to be made to any specification. The cartridges are restrained or blocked on one end only, hence there is no thermal expansion problem. The heating or cooling medium is introduced into the cartridges through a flange chamber at the end portion of the cartridge. This flange chamber is semi-circular or comprises 180° of the end of the chamber and is connected directly to the inside of the cartridge. A second exit flange chamber adjacent to the first receives the heating or cooling medium after it has circulated through the cartridge and returned. These large entrance and exit flange chambers allow the half-circular chamber to fill up completely and flood the whole half-circle of the heat exchanger completely. The circumferential edge of each flange chamber is recessed to accomodate a circular O-ring circumferentially positioned around each flange chamber therefore at 90° to the line of pressure. When cartridges of the heat exchanger are assembled and in position, these O-rings bear against the internal portion of the adjacent flange chamber to seal the fluid therein.

Accordingly, an object of this invention is to provide a hollow flanged 180° entry of the heating medium into the device.

Another object of this invention is to provide a double helix path for the heating medium contained within hollow concentric cylinders of the device.

Yet another object of this invention is to provide gaskets on the outer edge of the assembly flange of the device to preserve a pressure-safe type seal and allow easy assembling and disassembling of the heat exchanger.

Another object of the invention is to provide a heat exchange device, the internal portion of which may be coated with glass so as to resist corrosive fluids.

Another object of the invention is to provide processes for the manufacture of a helical path on the outside of cylindrical elements utilizing a helical divider.

Another object of the invention is to provide a manufacturing process for welding a helical path on the surface of the cylinder utilizing arc-shaped strips of sheet metal.

These and other objects of the invention will become obvious in parts hereinafter pointed out.

FIG. 1 is a cross-sectional longitudinal view taken through the mid-line of the invention.

FIG. 2 is a perspective view of an outside cartridge of the invention, showing the flow pattern of the product.

FIG. 3 is a view of the cartridge of FIG. 2, partially in cross-section, showing the double helix flow pattern of the cooling medium.

FIG. 3*a* is a cross-sectional view of a cartridge modification of the invention showing the method for welding a spiral chamber on the surface of said cartridge.

FIG. 4 is a perspective view of a cartridge of FIG. 2, showing in ghost view the assembly of the adjacent cartridge.

FIG. 5 is a cross-sectional view of the modification of the invention having rounded end portions of the cartridges and with surfaces of the cartridges coated with a glass or plastic film.

FIG. 6 is a cross-sectional view of a cartridge of FIG. 5, showing the spiral flow pattern thereon.

FIG. 6*a* is a perspective view of the cartridge of FIG. 6, showing external spiral dividers thereon.

FIG. 7 is a cross-sectional view of the end portion of the cartridge of FIG. 6, showing the adjacent cartridge and the sealing gasket therebetween.

Figure 8:
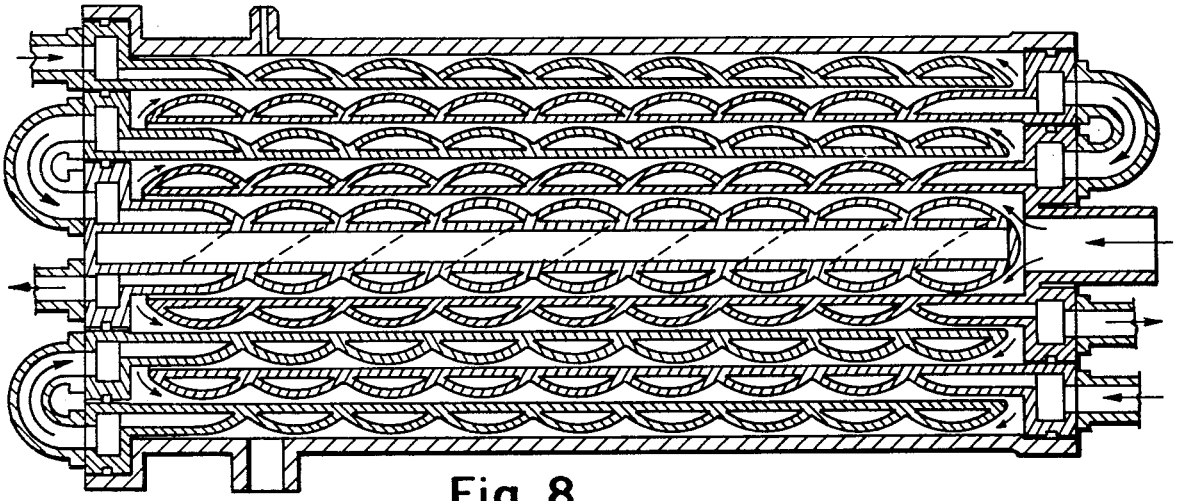

FIG. 8 is a longitudinal cross-sectional view of a modification of the invention of FIG. 1, showing the cartridges constructed of arc-shaped tubing welded to form a helical path along the periphery of each cartridge.

Figure 9:
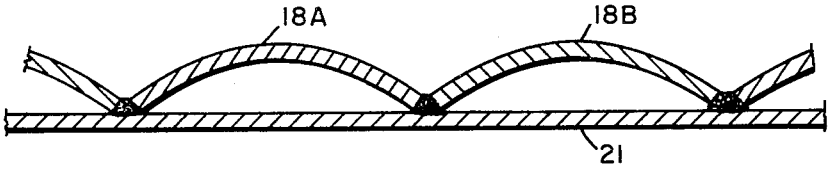

FIG. 9 is an enlarged cross-sectional view of a portion of a cartridge of FIG. 8, showing the welding thereon.

Referring now to the drawings and in particular to FIG. 1, 10 designates the heat exchanging apparatus embodying the invention. This apparatus comprises a cylindrical metal shell 11 of a suitable axial extent. A series of concentric, cylindrical assemblies or cartridges are arranged for removable mounting within said shell 11; said assemblies defining torodial paths for movement of liquid to be heated and toroidal chambers for bringing a heating medium in heat transfer relation to the moving liquid. Reference to FIGS. 1–4 of U.S. Pat. No. 3,612,002 will illustrate the basic physical arrangement of the device upon which this improvement patent application is based.

Referring now to FIGS. 1, 2 and 3 of the application, within cylindrical metal shell 11, and adjacent thereto, there is a cylindrical cartridge 12, within which there is positioned a cylindrical double wall cartridge 14 within which there is cylindrical double wall cartridge 16. Cylindrical double wall cartridge 12 is made up of two concentric cylinders having the end portion thereof sealed. The cartridge 12 is comprised of the outer wall 18 and inner wall 21 with an annular chamber 20 therebetween. The end portion of outer wall 18 and inner wall 21 is connected to an annular shaped hollow-flange chamber 22, divided by two median walls 26 (FIG. 3) across the diameter thereof to produce two divided flange chambers 23 and chamber 25. An opening 28 communicates with chamber 23 and flange opening 30 communicates with the chamber 25.

Referring now to FIG. 2, a helical divider 32 is positioned between the outer wall 18 of the cartridge extending from flange chamber 22 to the end of cartridge 12. This helical divider 32 causes the product to flow along the outer wall 18 in a helical or spiral fashion. Referring now to FIG. 3, the chamber 20 is formed between the inner wall 21 and the outer wall 18 of cartridge 12. An internal helical divider 34 is positioned within chamber 20, extending from one edge of median wall 26 to the inner end portion of cartridge 12. A second internal helical divider 36 extends from the other end portion of median wall 26 in a spiral fashion within chamber 20, short of the end portion of chamber 12. It should be noted that this second internal helical divider 36 does not extend fully to the end portion of cartridge 12 but allows an opening through which fluid may pass. Both first internal helical divider 34 and second internal helical divider 36 are sealed against the internal surface of chamber 20 so that no fluid may pass. Thus a heating or cooling medium may be introduced through flange opening 30 within lower flange chamber 25, and be induced to flow in a spiral fashion down chamber 20, guided by internal helical dividers 34 and 36. The fluid then flows around the end portion of internal helical divider 36, and proceeds in a spiral fashion back along internal helical divider 34 into upper flange chamber 23 and out through opening 28. Cartridge 14 positioned within cartridge 12, and cartridge 16 positioned within cartridge 14 are constructed similarly to cartridge 12. Later described cartridges 38 and 40 have a similar construction.

The other end portion of heat exchanger 10 is comprised of outer cartridge 38, middle cartridge 40; each of which telescopes within cartridge 12 and cartridge 14 respectively. The construction of outer cartridge 38 and middle cartridge 40 is similar to that of the construction of cartridge 12. Each cartridge has inner and outer walls, a double flange chamber with medial wall within the flange chambers, an external helical divider on the surface of the outer wall and two internal helical dividers between the inner and outer wall. It should be noted than when heat exchanger 10 is assembled, cartridges 12, 14 and 16 do not extend to the flange chambers of cartridges 38 and 40, but rather leave a space or opening therebetween. Likewise, the end portions of cartridges 38 and 40 do not extend to the chamber 22 or other flange chambers of cartridges 12, 14 and 16, but leave an opening therebetween. Through these openings flow the product to be heated or cooled. FIG. 1 indicates the positioning of cartridges 14 and 38 relative to one another. It should be also noted that the outer lateral portions of the flange chambers of all the cartridges have an annular recess 39 therearound in which is positioned an O-ring 41. When heat exchanger 10 is assembled, the O-ring 41 bears against the inside surface of the adjacent flange, thereby sealing the heat exchanger against fluid leakage.

Referring again to FIG. 1, the heat exchanger 10 in its assembled position; a product tube 42 is positioned within the central portion of middle cartridge 40 for the entrance of product therethrough. Likewise cylindrical shell 11, on the top portion thereof, has an air vent tube 44 therethrough and on the bottom thereof a product exit tube 58 therethrough.

A straight manifold pipe is connected to the opening 28 of outer flange chamber 23. A U-shaped pipe 48 connects the flange opening of cartridge 14 with the flange opening of cartridge 16. Manifold pipe 51 connects the openings between cartridges 12 and 14. Likewise a manifold pipe 52 connects the outer openings between the manifold 38 and manifold 40.

In operation, the heating or cooling medium is introduced into opening 28 where it proceeds down chamber 20, guided by internal helical divider 34 around the end of helical divider 36 and back chamber 20 guided by internal helical divider 34 to the lower flange chamber 25, thence through manifold pipe 51 and into the flange chamber of cartridge 14. It then proceeds to chamber 20 of cartridge 14 guided by the double helix of helical dividers to the upper flange chamber of cartridge 14 through manifold pipe 48 into the upper flange chamber of cartridge 16. It proceeds through cartridge 16 in the same manner emerging therefrom through exit opening 54.

Likewise, the heating or cooling medium is introduced into opening 53, the flange chamber of outer cartridge 38, through a straight pipe, proceeds through the double helix path similar to that of cartridge 12, previously described, and emerges through manifold pipe 52 into the flange chamber of cartridge 38. The medium then proceeds down and back following the double helixes of cartridge 38 and emerges through exit opening 56 from whence it leaves the heat exchanger.

The product to be heated or cooled enters heat exchanger 10 through product entrance tube 42. It then flows around the end portion of cartridge 16 and proceeds along the surface of cartridge 16, guided by a helical divider 32 (FIG. 2) so that it flows along the surface of cartridge 16 in a helical fashion. At the end portion of cartridge 40, the product flows in the direction of the arrows in the annular opening between cartridge 14 and 40, guided by the helical dividers similar to 32 until it reaches the end portion of cartridge 14 whence it flows therearound in the opening between cartridges 38 and 14. The product then flows in a similar fashion around the end portion of cartridge 38 into the opening between cartridges 12 and 38 to the end portion of cartridge 12, thence in the chamber between the shell 11 and cartridge 12. Following this the product flows from the heat exchanger 10 to the outside via product exit opening 58. Any air that is trapped or traveling with the product will flow from the heat exchanger through a vent tube 44 provided for that purpose.

Frequently heat exchangers of the type described in this invention circulate corrosive fluids which will attack metal to which they are exposed. It is therefore often desirable to coat the flow surface of the exchanger with a glass coating or film which will resist the attack of corrosive fluids. Present technology makes it difficult to apply or maintain such a glass coating or film on angular corners or surfaces. Therefore a modification of this invention is presented as set forth in FIGS. 5, 6 and 7 in which the angular flow surfaces of the invention have been curved or rounded, and coated with a glass film or coat.

FIGS. 5, 6, 6a and 7 represent the glass or plastic film coated modification of the invention which corresponds to previously described FIGS. 1, 2 and 3, in configuration and which have identical numbers describing similar parts. The end portions of metal shell 11 have been rounded, as have been the angular surfaces of cartridges 12, 14, 16, 38 and 40. Outer wall 18 and inner wall 21 of cartridge 12 are rounded at their end portions whereby annular chamber 20 presents a smooth surface. Referring to FIG. 7, a hollow flange chamber 22A is rounded both externally and internally. A circular seal 59 is positioned between the rounded portion of shell 11 and chamber 22A. Seal 59 prevents leakage of fluids therethrough. Other unnumbered seals are similarly placed between all other described cartridges set forth in FIG. 5.

A glass or plastic film coating 19 is applied to outer wall 18 and inner wall of cartridge 12 so that the annular chamber 20 is completely covered by coating 19. Likewise, all the internal and external flow surfaces of cartridges 12, 14, 16, 38 and 40 are glass or plastic coated as well as the internal surface of shell 11. All flow surfaces contacted by heating or cooling medium or product are coated with a corrosive resistant film 19, such as glass or plastic.

A construction modification of the device of FIG. 1 is shown in FIG. 3A in which circular cross-section helical dividers 34 and 36 are replaced by square helical dividers 34A and 36A. Helical dividers 34A and 36A are welded on either side to the base cylindrical cartridge, in the form of a helix. The outer portion of chamber 20 is then formed by wrapping coiled sheet metal 18A and 18B about the helical dividers 34A and 36A so that the edge portion of the sheet metal abuts the helical dividers. A continuous weld of the coiled sheet metal is then made along the top portion of the divider, thus forming the outer cylinder of the cartridge.

The manufacturing process to construct this modification of the device would comprise the steps of:

1. Wrapping the cylindrical-shaped element with dividers which proceed along the base element in a helical fashion;
2. Continuously welding the divider to the cylindrical base element;
3. Wrapping a strip of sheet metal about said dividers whereby the lateral portion of said sheet metal is in contiguous contact with itself and the dividers;
4. Continuously wrapping the lateral contiguous edge of said sheet metal strip to said divider.

Yet another modification of the device is set forth in FIGS. 8 and 9. This modification utilizes a spiral tubing which proceeds helically along the surface of the base cylinder and cartridge. A process for manufacturing and construction of this spiral tubing is also described.

Coiled sheet metal of an appropriate width is wrapped around the cylindrical base element in the form of a helix. This sheet metal is formed into the shape of an arc with the concave portion in contact with the base element. The lateral edge portion of the sheet metal is then continuously welded producing a continuous half tube which proceeds in a helical fashion along the surface of the base element.

Inner wall 21 has an arc-shaped strip of sheet metal 18C and 18D wrapped spirally around so as to form a spiral passage therebetween leading from chamber 23 and terminating at opening 30. The other cylindrical elements of the device are likewise constructed.

The process of manufacturing this modification consists of the steps of:

1. Wrapping an arc-shaped strip of sheet metal about a cylindrical element in a spiral fashion;
2. Allowing the lateral edges of the metal strip to be in continuous contact with itself;
3. Continuously welding the said lateral edge of the metal strip to the base element.

In operation, the inside medium circulates through this continuous tube whereas the outside product circulates in the cavity without the continuous tube.

It is understood that the above description of the device is made by way of example only and that numerous modifications of the device may be made without departing from the spirit of the invention. For example, the device may consist of any number of cartridges and is not limited by the number of cartridges set forth in the above specification and drawing. Likewise, it is within the contemplation of the inventor that the flow path of the heating or cooling medium may be interchanged with that of the product.

I claim:

1. Apparatus for heating or cooling liquid in a heat exchanger, comprising in combination:

a cylindrical shell;

a plurality of annular concentric heating chamber cartridge means within said cylindrical shell;

means for removably mounting said annular concentric heating chamber cartridge means in said cylindrical shell;

said means for removably mounting comprising a plurality of annular concentric mounting member cartridges having internal chamber means therein, one set of said mounting member cartridges being located on one end of said shell and another set of said mounting member cartridges being located on the other end of said shell and placed in alternate sequence;

liquid inlet means for admitting a liquid heating or cooling medium within said chamber means, said chamber means being arranged to provide a plurality of axially extending, coaxial annular spaces for passing said liquid heating or cooling medium therein;

means for interconnecting said annular spaces;

liquid outlet means, said liquid inlet means for the liquid heating or cooling medium, each communicating with one coaxial annular space on each cartridge and liquid outlet means for the liquid heating or cooling medium each communicating with the internal chamber of the adjacent chamber cartridge means;

parallel mounting members comprising a hollow flange with two half circular chambers;

dividers within said mounting member cartridges which separate said internal chamber means into two inter-connected helical flow paths and which separate said hollow flange into two half circular chambers, said half circular chambers in communication with said heating chamber means.

2. The combination as claimed in claim 1, in which said annular concentric heating chamber means comprises a pair of concentric annular wall members;

a first helical rib member positioned between said concentric annular wall members and extending longitudinally the total length of said concentric annular wall members;

a second helical rib member positioned in between said concentric annular wall members and extending longitudinally short of the length of said concentric annular wall members;

whereby the liquid heating or cooling medium will flow within the space created by said first and second helical rib and return in the adjacent space created by said second and first helical rib.

3. The combination as claimed in claim 2, in which the outer edge of each of said mounting means has an annular slot concentrically positioned therein;

an O-ring positioned within said annular slot, whereby said O-ring will maintain sealing relationship with said adjacent mounting means.

4. The combination as claimed in claim 3, in which the surfaces of said annular spaces and said heating chamber means are rounded, so as to present no sharp corners and;

the surface of said annular spaces and said heating chamber means coated with a protective skin.

5. An apparatus for heating or cooling liquids in a heat exchanger, adapted to contain medium and product, comprising in combination:

a cylindrical shell;

a plurality of cylindrical concentric heating chamber cartridges means within said cylindrical shell;

means for removably mounting said cylindrical concentric heating chamber cartridges inside both ends of said shell, said means for removably mounting, comprising a plurality of annular concentric cartridges having internal chambers therein, one set of said cartridges being located on one end of said cylindrical shell and another set of said cartridges being located on the opposite end of said cylindrical shell, said cartridges placed in alternate spaced sequence creating an alternating sequence of cylindrical gaps in between the said cartridges, said gaps communicating in sequence to create a single path gap for the flow of product;

inlet means in communication with the first internal chamber within the cartridges adapted to admit a liquid heating or cooling medium into the internal chamber of said cartridges, said cartridges being connected to provide a sequence of serially axially extending coaxial annular chambers having an inlet and an outlet therein for the passage of the heating or cooling medium therein;

including series means for interconnecting said annular chambers with the adjacent annular chambers connecting the outlet of one of said internal annular chamber to the inlet of the next adjacent internal annular chamber.

6. The combination as claimed in claim 5, having a plurality of cartridges where each cartridge is formed out of two concentric cylinders including an axial cylindrical internal chamber, said axial cylindrical internal chamber being closed on one end, and being provided with an inlet and outlet means for the flow of medium on the opposite end portion of said axial cylindrical internal chamber;

said inlet and outlet means being formed in the shape of a hollow flange, said hollow flange being comprised of two semi-circular inlet portions, each one with an opening to the outside and a semi-circular outlet portion with openings to the inside of each cartridge;

means to connect said semi-circular outlet portion of one cartridge to the semi-circular inlet portion of the adjacent cartridge.

7. The combination as claimed in claim 6, having a plurality of cartridges, each cartridge being formed from two concentric cylinders including in between them an axial cylindrical chamber, said axial cylindrical chamber being divided by two helical members, positioned side by side to form a double helix, one member of said double helix adapted to direct the medium from said semi-circular inlet portion of said hollow flange to the closed end portion of said cartridge, the second member of said double helix being adapted to direct the medium from the closed end portion of said cartridge back to said semi-circular outlet portion of said hollow flange;

one member of said double helix being jointed to the closed end of said cartridge space, the second member of said double helix having an open end portion adjacent to the closed end of said cartridge, to permit the return of the medium to the semi-circular outlet portion of said hollow flange.

8. The combination as claimed in claim 7, in which said gap in between the neighboring cartridges is divided by another helical member to form a looping path in said gap between two adjacent cartridges for transmission of the product;

each cartridge stopping short of the flange of the adjacent cartridge allowing the product to flow in sequence from one gap to the next gap of the adjacent cartridges;

said helical members being looped around the outside surface of each cartridge and adapted to permit the same sense of rotation of the product by means of left hand helixes on the odd numbered cartridges and right hand helixes on the even numbered cartridges.

9. The combination as claimed in claim 6, in which the outer edge of said hollow flanges has an annular slot concentrically positioned therein;

an O-ring, positioned within said annular slot, whereby said O-ring will maintain sealing relationship with said adjacent hollow flange.

* * * * *